US008132793B2

(12) United States Patent
Liu

(10) Patent No.: US 8,132,793 B2
(45) Date of Patent: Mar. 13, 2012

(54) METHOD AND APPARATUS FOR LIQUID PRECURSOR ATOMIZATION

(75) Inventor: Benjamin Y. H. Liu, North Oaks, MN (US)

(73) Assignee: MSP Corporation, Shoreview, MN (US)

( * ) Notice: Subject to any disclaimer, the term of this patent is extended or adjusted under 35 U.S.C. 154(b) by 375 days.

(21) Appl. No.: 12/557,980

(22) Filed: Sep. 11, 2009

(65) Prior Publication Data

US 2010/0065972 A1 Mar. 18, 2010

Related U.S. Application Data

(60) Provisional application No. 61/096,384, filed on Sep. 12, 2008.

(51) Int. Cl.
*B01F 3/04* (2006.01)

(52) U.S. Cl. ..... 261/76; 118/715; 261/78.2; 261/152; 261/DIG. 65; 427/96.7; 427/96.8

(58) Field of Classification Search ..... 261/76, 261/78.2, 152, 155, 156, DIG. 65; 118/600, 118/715, 720, 726; 427/96.7, 96.8
See application file for complete search history.

(56) References Cited

U.S. PATENT DOCUMENTS

| | | | | | |
|---|---|---|---|---|---|
| 1,594,947 | A | * | 8/1926 | Hartman et al. | 261/76 |
| 1,864,037 | A | * | 6/1932 | Atkins | 261/77 |
| 2,020,850 | A | * | 11/1935 | Myhren et al. | 261/76 |
| 2,060,557 | A | * | 11/1936 | Davis | 261/157 |
| 2,102,042 | A | * | 12/1937 | Spence | 568/850 |
| 2,127,571 | A | * | 8/1938 | Pardee, Jr. | 95/201 |
| 3,833,719 | A | * | 9/1974 | Kuerten et al. | 423/659 |
| 4,320,092 | A | * | 3/1982 | Kondo et al. | 422/224 |
| 4,687,643 | A | * | 8/1987 | Cortesi et al. | 422/150 |
| 4,701,194 | A | * | 10/1987 | Weyers et al. | 96/242 |
| 4,717,049 | A | * | 1/1988 | Green et al. | 222/420 |
| 4,850,205 | A | * | 7/1989 | Mills | 62/308 |
| 5,160,458 | A | * | 11/1992 | Yap | 261/76 |
| 7,422,198 | B2 | * | 9/2008 | Yoshioka et al. | 261/130 |
| 7,547,003 | B2 | * | 6/2009 | Okabe et al. | 261/78.2 |
| 2006/0125129 | A1 | * | 6/2006 | Takamatsu et al. | 261/142 |
| 2007/0040288 | A1 | * | 2/2007 | Emilsen et al. | 261/76 |
| 2011/0192909 | A1 | * | 8/2011 | Liu et al. | 239/4 |

FOREIGN PATENT DOCUMENTS

JP 56-5124 A * 1/1981

* cited by examiner

*Primary Examiner* — Richard L Chiesa
(74) *Attorney, Agent, or Firm* — Westman, Champlin, Kelly, P.A.; Z. Peter Sawicki

(57) ABSTRACT

An apparatus for atomizing a precursor liquid for vapor generation and thin film deposition on a substrate. The precursor liquid is atomized by a carrier gas to form a droplet aerosol composed of small precursor liquid droplets suspended in the carrier gas. The droplet aerosol is then heated to form vapor, producing a gas/vapor mixture that can be introduced into a deposition chamber to form thin films on a substrate. The liquid is introduced into the atomizing apparatus in such a manner as to avoid excessive heating that can occur or lead to the formation of undesirable by-products due to material degradation as result of thermal decomposition. The apparatus is particularly suited for vaporizing high molecular weight substances with a low vapor pressure that requires a high vaporization temperature for the liquid to vaporize. The apparatus can also be used to vaporize solid precursors dissolved in a solvent for vaporization.

15 Claims, 3 Drawing Sheets

METHOD AND APPARATUS FOR LIQUID PRECURSOR ATOMIZATION

CROSS-REFERENCE TO RELATED APPLICATION

The present application is based on and claims the benefit of U.S. provisional patent application Ser. No. 61/096,384, filed Sep. 12, 2008, the content of which is hereby incorporated by reference in its entirety.

BACKGROUND OF THE DISCLOSURE

Thin film deposition on a substrate for semiconductor device fabrication and other applications is frequently accomplished through a gas phase process using a gas/vapor mixture containing the precursor vapor needed for film formation. The mixture is usually introduced into a deposition chamber under suitable temperature and pressure conditions to form a thin film on the substrate. In the case of a precursor in liquid form, the precursor vapor can be generated by heating the liquid to a suitably high temperature. A carrier gas can then be bubbled through the liquid to saturate the gas with vapor to form the desired gas/vapor mixture. Alternatively, vapor can be generated by injecting the liquid directly onto a hot metal surface to vaporize the liquid and form vapor. At the same time, a carrier gas is also injected to carry away the vapor to produce the gas/vapor mixture. In recent years, liquid vaporization through direct liquid injection and droplet vaporization is increasingly used. In this process, the precursor liquid is injected into an atomization apparatus with a carrier gas to form a droplet aerosol comprised of small droplets suspended in the gas. The droplet aerosol is then heated to form a gas/vapor mixture in a heated vaporization chamber.

Precursor vaporization by atomization followed by droplet vaporization in the carrier gas has the advantage that droplets are vaporized while suspended in the gas. Heat is transferred indirectly from the heated vaporization chamber walls through the gas, then into the suspended droplets for vaporization. Direct contact between the liquid and a hot metal surface can be eliminated. Contact between the precursor liquid and a hot metal surface can cause the precursor to thermally decompose to form undesirable by products. Droplet vaporization can greatly reduce thermal decomposition to produce a high purity gas/vapor mixture to form thin films in semiconductor device fabrication. In addition, due to the evaporative cooling effect, the surface temperature of an evaporating droplet remains low, further reducing thermal decomposition that can occur in the liquid phase at sufficiently high temperatures.

While droplet vaporization has been used successfully in recent years to vaporize precursor chemicals for semiconductor device fabrication, many modern precursor chemicals are difficult to vaporize. The problem of thermal decomposition and by-product formation has remained as a result of design shortcomings in the liquid atomization apparatus. This is particularly true for high molecular weight precursors with a low vapor pressure. Such low vapor pressure precursors typically have a molecular weight higher than 300. Their vaporization requires the use of comparatively high vaporization temperatures. Yet, these precursor chemicals are less stable and prone to thermal decomposition that can form by-products that are harmful to the semiconductor device being fabricated.

When liquid is introduced into a heated vaporization chamber through an atomizer, the small liquid flow passageway usually must pass through a high temperature region in which the liquid passageway itself becomes heated. Over time, decomposition products can faun and accumulate in the small, heated liquid flow passageway and cause the passageway to become clogged. The accumulated decomposed material in the liquid flow passageway can also be dislodged and appear as a gas-borne contaminant in the gas/vapor mixture. These contaminants can be carried by the gas/vapor mixture into the deposition chamber and deposit on the substrate surface to contaminate the substrate. The result is increased surface particle count on the product wafer, and increased defects in the device, and the loss of product yield.

SUMMARY OF THE DISCLOSURE

The present disclosure relates to an apparatus for atomizing a precursor liquid for vapor generation and thin film deposition on a substrate. The precursor liquid is atomized by a carrier gas to form a droplet aerosol comprised of small precursor liquid droplets suspended in the carrier gas. The droplet aerosol is then heated to form vapor, producing a gas/vapor mixture that can be introduced into a deposition chamber to form thin films on a substrate. The liquid is introduced into the atomizing apparatus in such a manner as to avoid excessive heating that can occur or lead to the formation of undesirable by-products due to material degradation as result of thermal decomposition. The apparatus is particularly suited for vaporizing high molecular weight substances with a low vapor pressure that requires a high vaporization temperature for the liquid to vaporize. It can also be used to vaporize solid precursors dissolved in a solvent for vaporization. The apparatus can be used for a variety of thin film deposition processes for semiconductor, integrated circuit device fabrication on silicon and other semiconductor substrates by such processes as chemical vapor deposition (CVD), atomic layer deposition (ALD), plasma-enhanced CVD (PE-CVD), among others. The molecular weight of the precursor for which the atomization apparatus described herein is particularly suited for molecular weights generally higher than 300.

DESCRIPTION OF THE EXEMPLARY EMBODIMENTS

Figure 1:
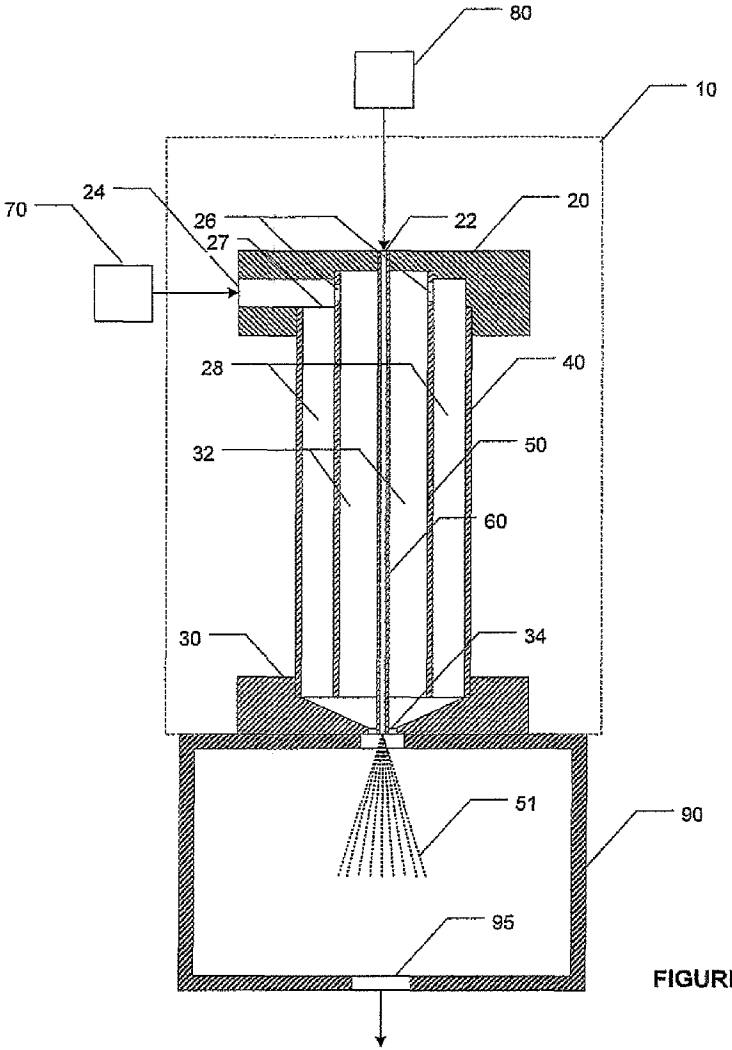
FIG. 1 is a schematic view of the atomization apparatus of one embodiment

FIG. 1 is a schematic diagram of one embodiment of the atomization apparatus. Like reference characters will be used for like elements throughout the Figures. The atomization apparatus is shown generally at 10. It is provided with a liquid source 80 containing a precursor chemical to be vaporized, and a gas source 70 containing a carrier gas used for atomizing the liquid to form a droplet aerosol for vaporization. The atomization apparatus 10 is connected to a heated vaporization chamber 90 in which the droplet aerosol 51 produced by the atomization apparatus 10 is vaporized to form a gas/vapor mixture. The resulting gas/vapor mixture then flows out of the vaporization chamber through outlet 95 into a deposition chamber (not shown) for thin film deposition and/or semiconductor device fabrication.

The atomization apparatus 10 is provided with a header 20 with a liquid inlet 22 for the precursor liquid from source 80 to enter, and a gas inlet 24 for the carrier gas from gas source 70 to enter. Upon entering inlet 22, the liquid flows down the small metal capillary tube 60 until it exits the other end of the capillary tube, which is open. At the same time carrier gas from source 70 enters the atomization apparatus through inlet 24. The gas then passes through openings 26 in inner tubular member 50 and opening 27 in outer tubular member 40 to form two separate streams. One stream flows downward through the gas flow passageway 28 formed between the outer tubular member 40 and inner tubular member 50. The other stream flows downward through the gas flow passageway 32 formed between inner tubular member 50 and the capillary tube 60. As these gas streams reach the lower end of the gas flow passageways, which are open, they combine to form a single stream. This gas stream then flows through the small orifice 34 to produce a high velocity gas jet, which atomizes the liquid flowing out of the end of the metal capillary to form a spray of fine droplets 51 in the heated vaporization chamber 90, the vaporization chamber being attached to the bottom flange 30 of the atomization apparatus.

The apparatus 10 is designed to operate in a vacuum environment, so that all parts of the system forming the outer envelope of the system including header 20 on the top, flange 30 on the bottom, and tubular member 40 on the side are constructed to avoid leaks. Header 20, flange 30 and tubular member 40 can be machined out of a single solid piece of metal, or fabricated as separate parts and welded together to form an overall leak free envelop for gas and liquid flow and atomization. Similarly, the bottom flange 30 is also attached to the vaporization chamber 90 through a leak-proof seal. All parts of the system including header 20, flange 30 and tubular member 40, and tubular member 50 and capillary tube 60 are usually made of stainless steel or other corrosion free metal to avoid contamination due to corrosion and erosion.

The atomization apparatus 10 is designed to operate with a heated vaporization chamber. For high molecular weight precursors, the vaporization temperature is typically greater than 100 degree C. For some precursors, especially those that exist as a solid at room temperature, vaporization temperatures as high as 350° C. or higher may be needed. For such solid precursors, the solid must be dissolved in a solvent and then atomized to form droplets to vaporize both the solvent as well as the solid precursor.

When precursor flows through a liquid flow passageway, such as metal capillary tube 60 of the atomization apparatus 10, it is important that the temperature of the liquid flow passageway be carefully controlled and kept low to avoid the precursor liquid from thermally decomposing while flowing through the metal capillary. In the case of a solvent-based solid precursor, the solvent may evaporate in a heated liquid flow passageway leaving the solid precursor behind to deposit in the small liquid flow passageway and cause it to clog. The manner in which the temperature of metal capillary tube 60 is controlled in the atomization apparatus 10 is described below.

Since all parts of the atomization apparatus 10 are constructed of metal, usually stainless steel, and the apparatus is attached to the heated vaporizer chamber 90 through the bottom flange 30, apparatus 10 is generally in good thermal contact with vaporization chamber 90. If the vaporization chamber 90 is operated at a temperature, for example, 130° C. to vaporize the precursor droplets produced by atomization apparatus 10, apparatus 10 with a design similar to that shown in FIG. 1, but without the special design considerations described below, will also be at a temperature close to the vaporization chamber temperature, i.e. 130° C. Since the atomization apparatus is protruding into an ambient environment, which is at a somewhat warmer temperature than the typical 20° C. temperature of a cleanroom, header 20 of apparatus 10 may be at a temperature somewhat cooler than the vaporization chamber temperature of 130° C. Metal capillary tube 60, which is in good thermal contact with header 20, will thus also be at a temperature that is somewhat cooler than the temperature of the vaporization chamber.

To reduce the temperature of header 20 and the temperature of the capillary tube 60, which is attached to the header and in good thermal contact with it, apparatus 10 is constructed of a thin wall tubular member 40 of a long length, the tube wall thickness and length being sufficient to produce a temperature drop of at least about 30° C. as heat is conducted from the heated vaporization chamber to the relatively cooler header 20. Since the capillary tube is in good thermal contact with heater 20, the temperature of the capillary, therefore, will also be about 30° C. or more cooler than header 20.

Conduction of heat through the walls of a tubular shaped member from one end to the other is governed by Fourier's law of heat conduction, $$Q = \frac{kA\Delta T}{L} \tag{1}$$

where Q is the rate of heat transfer from the hot end of the tube to the cooler end, k is the thermal conductivity of the tube, A is the cross-sectional area of the tube, L is the tube length, and ΔT is the temperature drop from the hot end to the cold end of the tube. For a thin-wall tube with a diameter, D, and wall thickness t, the cross-sectional area A is $$A=\pi Dt \tag{2}$$

The rate of heat conduction therefore will be $$Q = \frac{k\pi Dt\Delta T}{L} \tag{3}$$

Equation (3) shows that the rate of heat conduction through the tubular member 40 is directly proportional to the thickness, t, of the tube, and inversely proportional to its length. Reducing the thickness and increasing the tube length will decrease heat conduction through the tube. Since the cold end of the tube is connected to header 20 and at substantially the same temperature as header 20, heat transferred by conduction from the hot end to the cold end of the tube must be dissipated to the ambient by natural convection and radiation through the header. Reducing the rate of heat conduction to the cold end will thus reduce the temperature difference between header 20 and the temperature of the surrounding environment, and make the header temperature closer to the surrounding room temperature. The header will thus become cooler.

The above analysis shows that a simple and yet effective way of reducing the temperature of header 20, as well as the temperature of the capillary tube that is attached to it, is to make the wall thickness, t, of the tube small or make the tube length, L, long, or both. Additionally, the carrier gas, upon entering gas inlet 24 and flowing through the gas flow passageways 28 and 32 will form two cold sheath flow streams. One stream will flow through passageway 32 to help cool metal capillary 60 in the section below the header. The other stream will flow through passageway 28 to help cool the tubular housing 40, by carrying away additional heat that would otherwise be conducted through the tube into the header. By this means, the carrier gas that is used to atomize the liquid to form a droplet aerosol will be used additionally to help cool the header and the section of the capillary tube below the header to which it is attached.

Experiments have shown that the above approach can increase the temperature drop from flange 30 to header 20 and metal capillary tube 60 to about 90° C. without making the tubular walls too thin, or its length too long. The walls of the tubular housing 40 can only be made so thin due to operational pressures being below atmospheric. The thickness of the tubular housing must be able to withstand a vacuum. However, the thinner the tubular housing, the less will be the heat conduction from the vaporization chamber. In addition, the longer the tubular housing, the heat conduction will also be less. However, the tubular housing 40 should not be so long as to make the apparatus difficult to use. It will be appreciated that the length of the capillary tube 60 and the inner tubular member 50 will have to correspond to the length of the tubular housing 40.

Figure 2:
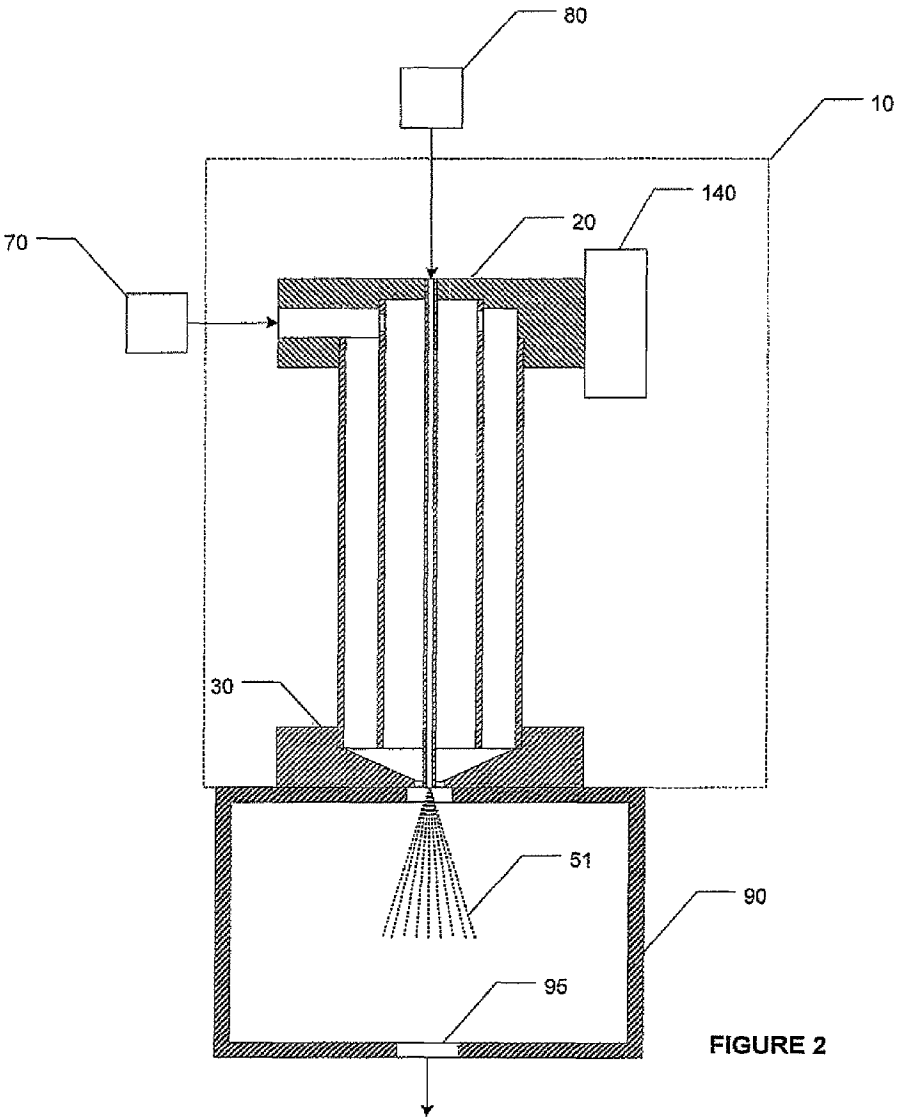
FIG. 2 is a schematic view of another embodiment of the atomization apparatus of the present disclosure.

FIG. 2 shows another embodiment of the apparatus of the present invention. All parts of the system are the same as those shown in FIG. 1 except for the addition of an extended surface heat exchanger 140. Heat exchange 140 is placed in good thermal contact with header 20, and has an extended surface area so heat can dissipate efficiently by natural convection. With the addition of heat exchanger 140 to provide additional area for heat dissipation, the temperature of header 20 can be further reduced, and brought closer to the ambient temperature around the apparatus.

Figure 3:
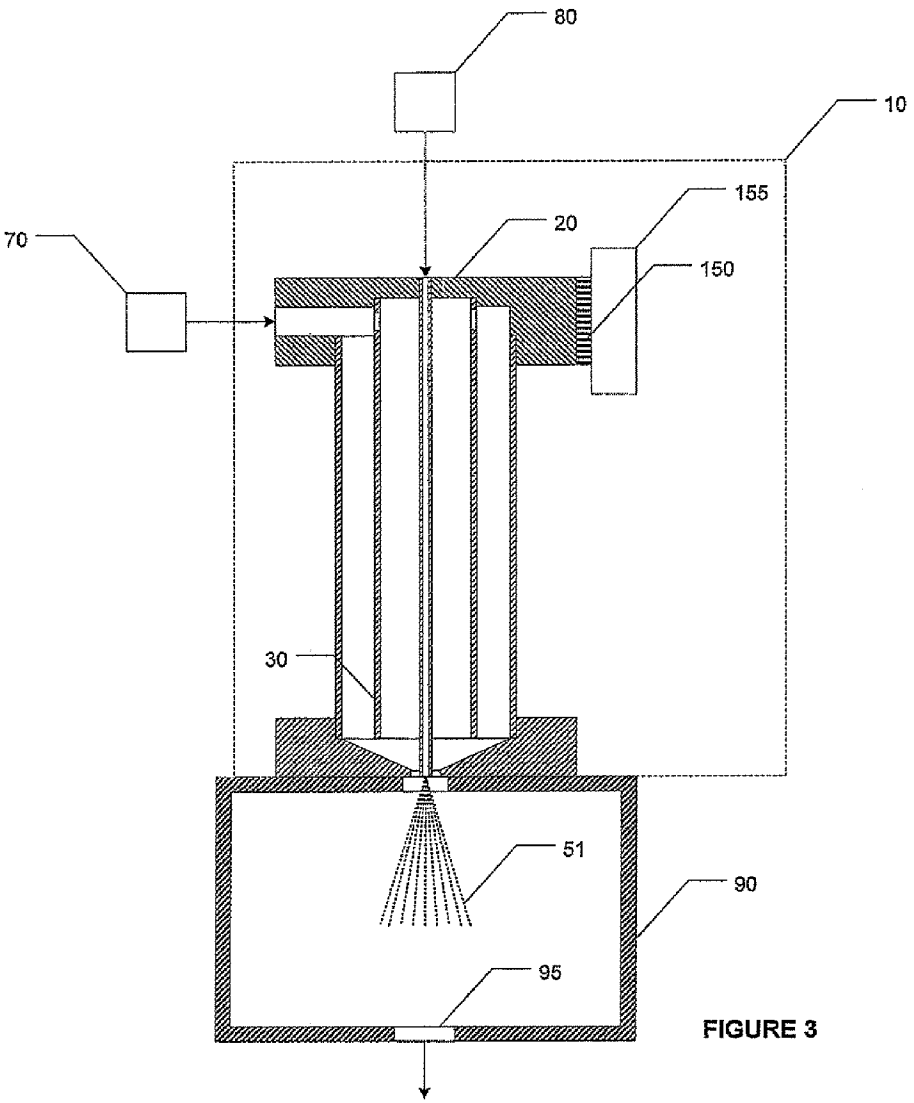
FIG. 3 is a schematic view of yet another embodiment of the atomization apparatus of the apparatus of the present disclosure

FIG. 3 is yet another embodiment of the apparatus of the present invention. All parts of the system are the same as in FIG. 1 except for the addition of a thermoelectric module comprised of a thermoelectric cooler element 150 and the attached natural convection cooling fins 155. The thermoelectric cooler is of a conventional design that can produce a cooling effect with the application of a DC current through the cooler. The heat removed is then dissipated by cooling fins to which the thermoelectric cooler is attached. The associated electrical and electronic circuitries needed to produce the desired DC current to produce the thermoelectric cooling effect is not shown as the technology is well known to those skilled in the art of cooling system design with the thermoelectric cooling effect. With the addition of a thermoelectric cooler, the header temperature can be maintained at near the ambient room temperature, or even below ambient temperature, thus making it possible to atomize liquid precursors at room temperature or below. This low temperature vaporizer is useful for vaporizer low vapor pressure precursors requiring a high vaporization temperature, or solid precursors dissolved in a solvent through the solution atomization process. Feeding a solution through a hot capillary tube will cause solvent to evaporate from the solution, leaving the solid precursor behind to clog the liquid flow passageway.

Other methods of cooling beyond those described in the present disclosure can also be used. These methods, including heat dissipation by using cooling water, cooling gas, or fan, etc, will be familiar to those skilled in the art of heating and cooling apparatus design, and will not be further described in this disclosure.

Although the present invention has been described with reference to preferred embodiments, workers skilled in the art will recognize that changes may be made in form and detail without departing from the spirit and scope of the invention.

What is claimed is:

1. An apparatus for atomizing a precursor liquid in a gas to form a droplet aerosol comprised of droplets suspended in the gas for vaporization and formation of a gas/vapor mixture for subsequent thin film deposition on a substrate, said apparatus comprising:

a tubular housing having a top and a bottom, said top being provided with a liquid inlet to receive liquid from a liquid source, said bottom being for attachment to a heated vaporization chamber to vaporize droplets formed by said apparatus, said housing including additionally a gas inlet to receive gas from a gas source;

a capillary tube within the housing to receive the liquid at an inlet capillary tube end entering the housing through said liquid inlet and discharging the liquid through an open outlet capillary tube end;

a gas-flow passageway between the tubular housing and said capillary tube; and an atomizing orifice for the gas to flow through to create a high velocity gas jet to atomize the liquid discharged through the capillary tube to form droplets suspended in the gas and said tubular housing having a sufficiently thin wall and a sufficiently long length to produce a temperature difference of at least about 30° C. between the vaporization chamber and the inlet capillary tube end.

2. The apparatus of claim 1 having an additional tubular member between the tubular housing and the capillary tube to divide said gas flow passageway into two separate gas flow passageways.

3. The apparatus of claim 1 including a heated vaporization chamber for forming a gas/vapor mixture for thin film deposition on a substrate.

4. The apparatus of claim 1 including a heat exchanger to dissipate heat from the top of said housing, said heat exchanger having an extended surface area for heat dissipation by natural convection.

5. The apparatus of claim 1 including a thermoelectric cooler to cool the top and lower its temperature.

6. The apparatus of claim 1 wherein the thickness and length of the tubular housing is determined by the temperature drop (ΔT) according to the following relationship:

$$\Delta T = \frac{QL}{k\pi Dt}$$

where Q=Rate of heat transfer from one end of the tubular housing to another end k=Thermal conductivity of the tubular housing D=Diameter of the tubular housing t=Thickness of the tubular housing L=Length of the tubular housing.

7. A method for decreasing heat transfer in an atomizer, the atomizer having a vaporization unit to which is delivered a precursor chemical in a carrier gas by way of a tubular housing, the atomizer producing a droplet aerosol for subsequent use in thin film deposition on a substrate, the method comprising:

reducing the thickness and increasing the length of the tubular housing sufficiently to achieve a temperature drop from the vaporization unit to a liquid precursor inlet of the tubular housing by at least about 30° C. and maintaining the thickness of the housing sufficient to withstand sub-atmospheric operating pressures.

8. The method of claim 7 wherein the precursor chemical is a liquid at room temperature and has a molecular weight higher than about 300.

9. The method of claim 7 wherein the precursor chemical is a solid at room temperature and is dissolved in a solvent.

10. The method of claim 7 wherein the temperature drop from the vaporization unit to the liquid precursor inlet of the tubular housing is further increased by directing the carrier gas through the housing.

11. The method of claim 7 wherein heat is further dissipated from a top of the housing through the use of a heat exchanger.

12. The method of claim 7 is further dissipated from a top of the housing through the use of a thermoelectric cooler.

13. The method of claim 7 wherein the thickness and length of the tubular housing is determined by the temperature drop (ΔT) according to the following relationship $$\Delta T = \frac{QL}{k\pi Dt}$$

where Q=Rate of heat transfer from one end of the tubular housing to another end k=Thermal conductivity of the tubular housing D=Diameter of the tubular housing t=Thickness of the tubular housing L=Length of the tubular housing.

14. The method of claim 7 wherein the tubular housing includes an inner passageway for the precursor chemical and a gas passageway in thermal conductive relationship with the inner passageway to extract heat from the precursor chemical as the precursor chemical travels through the inner passageway.

15. The method of claim 14 wherein the gas passageway is divided into concentric inner and outer gas tubular passageways each extracting heat from respective passageway walls.

* * * * *